US006739118B2

(12) United States Patent
Miliani et al.

(10) Patent No.: US 6,739,118 B2
(45) Date of Patent: May 25, 2004

(54) SAFETY DEVICE FOR A WASHING SYSTEM FOR LIQUID FUEL BURNERS IN GAS TURBINES

(75) Inventors: Alessio Miliani, Impruneta (IT); Fabio Segato, Dueville (IT); Laura Bennati, Empoli (IT)

(73) Assignee: Nuovo Pignone Holding S.p.A., Florence (IT)

( * ) Notice: Subject to any disclaimer, the term of this patent is extended or adjusted under 35 U.S.C. 154(b) by 1 day.

(21) Appl. No.: 10/244,611

(22) Filed: Sep. 17, 2002

(65) Prior Publication Data

US 2003/0051460 A1 Mar. 20, 2003

(30) Foreign Application Priority Data

Sep. 18, 2001 (IT) ..... MI200101949

(51) Int. Cl.[7] ..... F02G 3/00
(52) U.S. Cl. ..... 60/39.094; 60/39.463
(58) Field of Search ..... 60/804, 39.094, 60/39.463

(56) References Cited

U.S. PATENT DOCUMENTS 6,216,439 B1 * 4/2001 Nakamoto ..... 60/39.094
6,393,827 B1 * 5/2002 Nakamoto ..... 60/39.094
6,438,963 B1 * 8/2002 Traver et al. ..... 60/779
6,442,925 B1 * 9/2002 Dalton et al. ..... 60/39.094

* cited by examiner

*Primary Examiner*—Charles G. Freay
(74) *Attorney, Agent, or Firm*—Nixon & Vanderhye

(57) ABSTRACT

A safety device for a washing system for liquid fuel burners in gas turbines, in which these turbines are provided with separate injectors for the combustion of liquid fuel or gaseous fuel, wherein the washing system comes into use when gaseous fuel is used and comprises a feed pipe for washing gas, a manifold from which liquid fuel is distributed to the burners, and a drainage pipe in order to discharge deposits of liquid; on the feed pipe there is inserted a closed tank in which there are provided apertures both for an intake pipe and for an outlet pipe for the washing gas, for the drainage pipe and for at least two liquid level sensors.

10 Claims, 2 Drawing Sheets

SAFETY DEVICE FOR A WASHING SYSTEM FOR LIQUID FUEL BURNERS IN GAS TURBINES

BACKGROUND OF THE INVENTION

Figure 1:
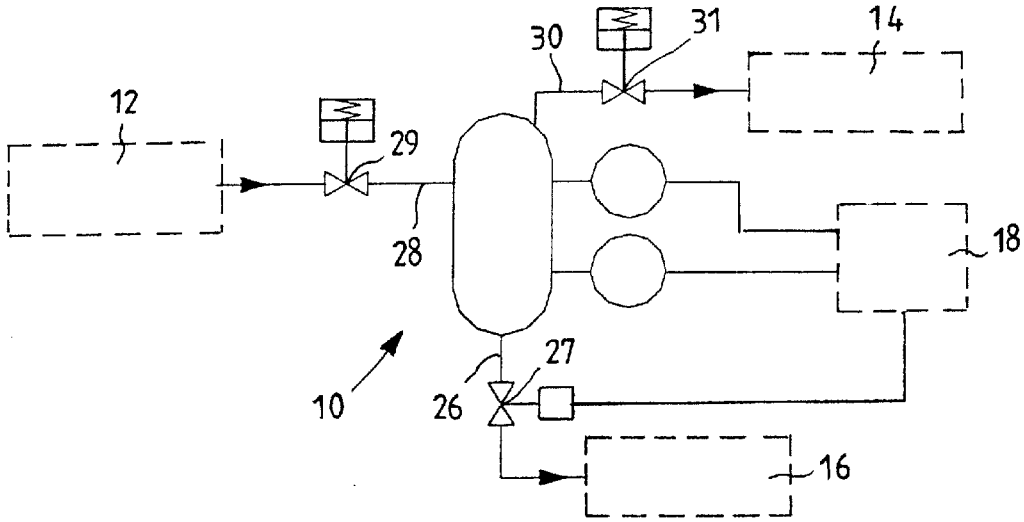

The present invention relates to a safety device for a washing system for liquid fuel injectors in gas turbines.

As is known, gas turbines comprise a compressor in which air obtained from the external environment is compressed.

This compressed air passes into a series of combustion chambers which contain one or more burners, into each of which an injector feeds fuel which is mixed with the air in order to form a mixture of air and fuel to be burnt.

Subsequently the burnt gases are conveyed to the turbine, which transforms the enthalpy of the gases burnt in the said combustion chamber into mechanical energy which is available to a user.

In particular, there exist gas turbines which function with "dual fuel", i.e. with two types of fuel, in other words liquid or gaseous.

In this case the turbines are provided with separate injectors for combustion respectively of the gaseous or liquid fuel.

When the turbine is functioning with gaseous fuel, the liquid fuel injector is not fed and therefore it becomes necessary to wash the injectors which are not being used with a flow of inert gas or air. This is in order to prevent intake of mixtures of air and fuel or burnt gases in cases in which there is not a perfect seal upstream from the injector.

In addition, the continuous washing has a beneficial effect of cooling the injectors and eliminates any residual trace of liquid fuel which could cause problems. If in fact liquid fuel remains inside the burner, it could become carbonised owing to the effect of the high temperature and therefore block the injection holes of the injectors.

Advantageously, the continuous washing of the burners can be carried out with the air taken from the outlet of the axial compressor of the turbine, using the pressure difference between the compressor outlet and the interior of the combustion chamber. For this reason the washing is known as "passive", since use is made of the loss of pressure in the combustion chamber.

Additionally, the system for this washing must be provided with a protection device, so that when the burner is fed with the liquid fuel, the latter cannot flow back through the washing air feed pipe into the compressor discharge box, with the risk of self-ignition and consequent serious structural damage to the turbine.

At present the system is produced using a stop valve on the air feed line, through which a manifold which distributes the air to the various burners is fed.

Each pipe which connects the air manifold to the various burners is then provided with a further stop valve, whereas at the lowest point of the manifold there is provided a drainage valve which is connected to an external system for collection of the drainage products.

When the turbine is functioning with gaseous fuel, the stop valve on the line for feeding air to the manifold and the stop valves on the burners are open, thus permitting washing of the burners. It will be appreciated that in this case the drainage valve remains closed.

On the other hand when the burner is fed with the liquid fuel, the stop valve on the air feed line, which for the sake of simplicity will also be called the feed valve, and the other stop valves, are closed, thus guaranteeing physical separation of the washing air obtained from the axial compressor, from the liquid fuel which is conveyed to the injectors.

In this case the drainage valve is open. By this means any blow-by of liquid fuel caused by breakage or imperfect sealing of a valve is collected in the manifold and discharged from the drainage collection system. This system can also be provided with a visual pilot lamp or other type of signal to indicate the leakage.

However, if this type of system were subjected to substantial leakages of liquid fuel, it would not be possible to guarantee adequate protection against the risk of dangerous self-ignition.

The object of the present invention is thus to eliminate the above-described disadvantages and in particular to provide a safety device for a washing system for liquid fuel injectors in gas turbines, which makes it possible to indicate the presence of leakages efficiently, directly on the control panel of the gas turbine.

Another object of the present invention is to provide a safety device for a washing system for liquid fuel injectors in gas turbines, which is particularly reliable, simple and functional, and has relatively low costs.

Advantageously, this safety device for a washing system for liquid fuel injectors in gas turbines guarantees the collection of leakages or condensation inside the latter, independently from the characteristics of the system downstream.

The characteristics and advantages of a safety device according to the present invention for a washing system for liquid fuel injectors in gas turbines will become more apparent from the following description provided by way of non-limiting example with reference to the attached schematic drawings, in which:

BRIEF DESCRIPTION OF THE DRAWING FIGURES

Figure 2:
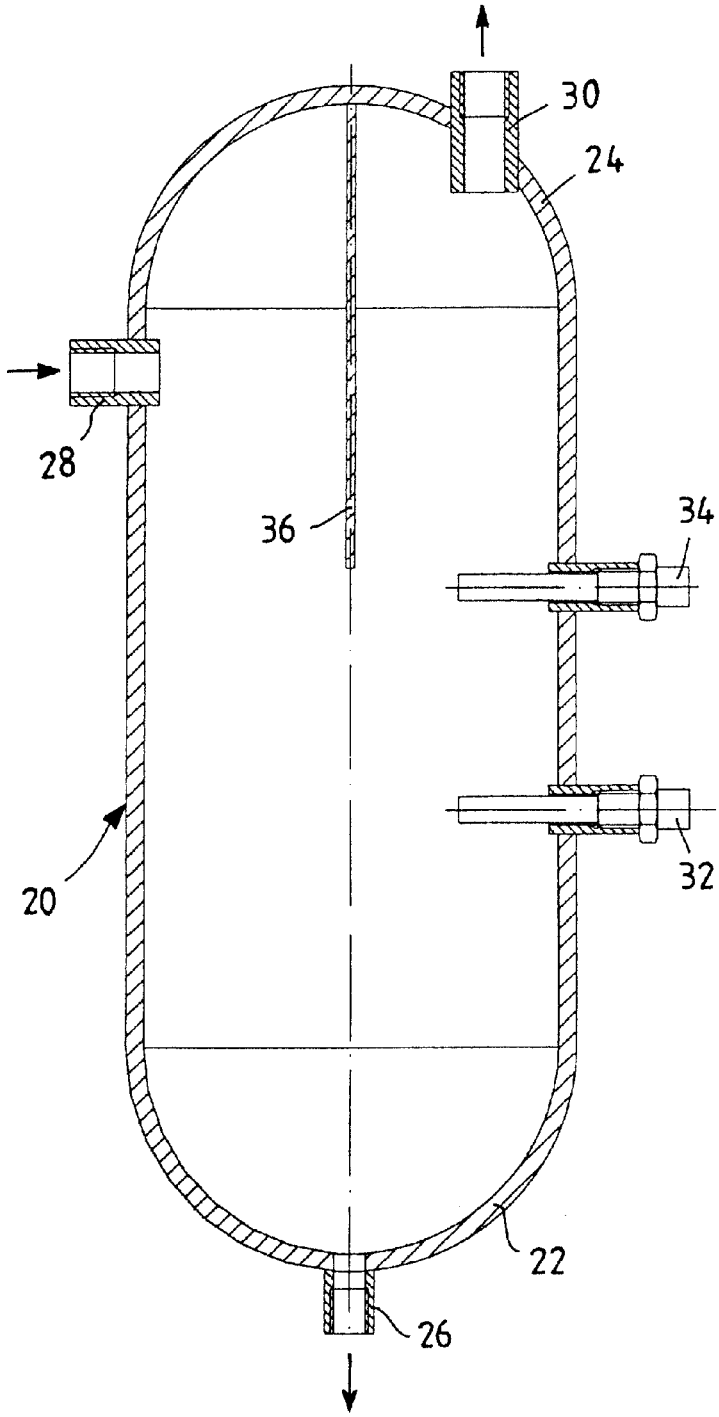

FIG. 1 is an operating diagram of a safety device according to the present invention, for a washing system for liquid fuel injectors in gas turbines; and FIG. 2 is a view in cross-section of a tank contained in the safety device in FIG. 1.

DETAILED DESCRIPTION OF THE INVENTION

The figures show a safety device for a washing system for liquid fuel injectors in gas turbines, which is indicated as 10 as a whole.

The device comprises a tank 20, which, in the non-limiting example illustrated in FIG. 2, has a cylindrical shape, is disposed with its axis vertically, and is closed at both ends by a lower curved surface 22 and an upper curved surface 24.

The lower surface 22 is provided with an aperture for a drainage pipe 26.

Laterally on the tank 20 there is provided an aperture for an intake pipe 28 for air, whereas on the upper surface 24 or laterally on the tank 20 there is provided an aperture for an outlet pipe 30 for air.

Again laterally on the tank 20 there are provided two apertures at different heights for a lower level sensor 32 and for an upper level sensor 34, which are connected to a control panel 18 for the turbine.

Inside the upper curved surface 24 of the tank 20 there is provided a flat divider baffle 36, which divides an upper area of the tank 20 into two.

The intake pipe 28 is engaged opposite the baffle 36, whereas the outlet pipe 30 is engaged in an upper area of the tank 20, which, relative to the baffle 36, is in a position opposite that in which the pipe 28 enters.

Advantageously, the upper sensor 34 is positioned just below a lower end of the divider baffle 36.

As can be seen in FIG. 1, on the intake pipe 28, outside the tank 20, there is provided a first stop valve 29 for washing air obtained from an axial compressor 12 of the gas turbine, whereas on the outlet pipe 30, again outside the tank 20, there is provided a second stop valve 31 for a manifold 14 which is connected to the liquid fuel injectors of the gas turbine.

Finally, on the drainage pipe 26, outside the tank 20, there is provided a third valve 27 for a drainage collection system 16.

The functioning of the safety device for a washing system according to the invention for liquid fuel injectors in gas turbines is apparent from the foregoing description provided with reference to the figures, and, briefly, is as follows.

Two stop valves 29 and 31 are disposed on the feed line for the washing air which feeds the manifold 14 for washing of the liquid fuel injectors.

Between these two stop valves 29 and 31 there is provided a tank 20 to collect any drainage products and discharge them into a collection system 16 by means of the drainage valve 27.

Liquid can be collected from inside the tank 20 both in the case in which there is blow-by of liquid fuel, and when there is gradual accumulation of condensation caused by the humidity of the air.

The two level sensors 32 and 34, which are positioned on two different levels, determine when liquid has gathered and transmit this fact to the turbine control panel 18.

During the washing of the burners, if the lower sensor 32 indicates the presence of liquid, whether this is liquid fuel or condensation, the drainage valve 27 is opened by a command from the control panel 18 for a suitable period of time, such as to empty the tank 20. If this event re-occurs within a predetermined period of time, this indicates that there is a significant leakage of liquid fuel, such that the turbine is stopped by a command from the control panel 18.

If on the other hand it is the upper sensor 34 which indicates the presence of liquid, this indicates that the tank 20 is almost completely full, such that the control panel 18 commands an emergency stoppage of the turbine.

On the other hand if the washing is not active, i.e. if the stop valves 29 and 31 are closed and the drainage valve 27 is open, the tank 20 is permanently connected to the drainage collection system 16. In this condition it is impossible for condensation or liquid fuel to gather, unless there is a substantial leakage of fuel. In order to protect the turbine if the latter case occurs, if when the washing is not active one of the two sensors 32 and 34 indicates an increase in the level inside the tank 20, the turbine is stopped immediately by a command from the control panel 18.

Finally, suitable design factors, such as the presence of the divider baffle 36 in the tank 20 and the arrangement of the apertures for the intake 28 and outlet 30 pipes in opposite positions relative to the said divider baffle 36, prevent the liquid fuel from being able to rise in the intake pipe 28 by the effect of capillarity.

The description provided makes apparent the characteristics and corresponding advantages of the safety device which is the subject of the present invention, for a washing system for liquid fuel injectors in gas turbines.

In this respect it should be noted that the embodiment proposed provides protection against any leakages of liquid fuel, both of a small extent, in which case the leakages are discharged to the drainage collection system, and of a large extent, in which case the fault is identified promptly by the control panel, and the turbine is stopped.

In addition, the design characteristics of the tank guarantee collection of leakages or condensation inside the latter, irrespective of the characteristics of the washing system downstream, which must simply be provided with a continuous slope towards the tank itself.

Another advantage of the device is its capacity to be able to indicate the presence of leakages automatically, directly to the turbine control panel, which will be able to undertake the most appropriate corrective or preventative actions.

Finally, the arrangement of the two sensors on different levels also permits implementation of control logic for the functioning of the sensors. For example, if only the upper sensor indicates the presence of liquid, at least one of the two sensors is not functioning correctly.

Finally it is apparent that many modifications and variations, all of which come within the scope of the invention, can be made to the safety device thus designed, for a washing system for liquid fuel injectors in gas turbines; in addition all the details can be replaced by technically equivalent elements. In practice, any materials, forms and dimensions can be used, according to the technical requirements.

The scope of the invention is therefore delimited by the attached claims.

What is claimed is:

1. A safety device for a washing system for liquid fuel burners in a gas turbine, wherein said turbine has separate injectors for the combustion of liquid fuel or gaseous fuel, said washing system being enabled for use when gaseous fuel is used and comprising: a feed pipe for washing gas, a manifold for distributing liquid fuel to the burners, and a closed tank on said feed pipe having a drainage pipe to discharge any deposits of liquid, said closed tank further having apertures for an intake pipe and an outlet pipe for the washing gas, and first and second liquid level sensors.

2. A device according to claim 1, wherein the apertures of said level sensors are positioned at different heights along said closed tank above the aperture of the drainage pipe.

3. A device according to claim 1, wherein said tank is cylindrical, is disposed with its axis vertically, and is closed at both ends by a lower surface which receives said drainage pipe, and an upper surface, the apertures for said intake pipe and for said outlet pipe being provided in the said upper surface or in the cylindrical surface of the tank, the apertures for said level sensors being provided in the cylindrical surface of the tank.

4. A device according to claim 1, including a first stop valve on said intake pipe and outside the tank, a second stop valve on said outlet pipe, outside the tank, and a third stop valve on said drainage pipe, outside the tank, said valves being actuated according to commands from a control panel for the gas turbine, and in which information obtained from said level sensors is processed.

5. A device according to claim 1, including a flat divider baffle inside the upper surface of the tank, said divider dividing an upper area of the tank into two parts.

6. A device according to claim 5, an inlet aperture of said intake pipe lies opposite the baffle, an outlet aperture of said outlet pipe lying in a part of an upper area of said tank opposite that portion of the tank in which the aperture of the inlet pipe is provided.

7. A device according to claim 6, wherein said first level sensor is positioned below a lower end of the divider baffle, said first level sensor being above said second sensor.

8. A device according to claim 1, wherein said washing gas is an inert gas.

9. A device according to claim 1, wherein said washing gas is air obtained from an axial compressor of the gas turbine.

10. A device according to claim 1, any said deposit of liquid is comprised of condensation and/or liquid fuel.

* * * * *